United States Patent [19]

Fushiya et al.

[11] Patent Number: 4,567,950

[45] Date of Patent: Feb. 4, 1986

[54] VIBRATING MEANS IN A POWER DRILL

[75] Inventors: Fusao Fushiya; Akira Mizumoto; Michio Okumura, all of Anjo, Japan

[73] Assignee: Makita Electric Works, Ltd., Anjo, Japan

[21] Appl. No.: 528,938

[22] Filed: Sep. 2, 1983

[30] Foreign Application Priority Data

Sep. 7, 1982 [JP] Japan ..... 57-136005[U]

[51] Int. Cl.[4] ..... E02D 7/02

[52] U.S. Cl. ..... 173/48; 173/104; 173/109; 192/93 A

[58] Field of Search ..... 173/47, 48, 104, 109; 192/20, 93 A, 93 B, 67

[56] References Cited

U.S. PATENT DOCUMENTS

| | | | |
|---|---|---|---|
| 2,971,394 | 2/1961 | Christensen | 192/93 A |
| 3,736,992 | 6/1973 | Zanders et al. | 173/48 |
| 4,158,970 | 6/1979 | Laughor | 173/48 X |
| 4,384,622 | 5/1983 | Koziniak | 173/117 X |

FOREIGN PATENT DOCUMENTS

| | | | |
|---|---|---|---|
| 491040 | 2/1930 | Fed. Rep. of Germany | 192/93 A |

*Primary Examiner*—E. R. Kazenske
*Assistant Examiner*—Willmon Fridie, Jr.
*Attorney, Agent, or Firm*—Dennison, Meserole, Pollack & Scheiner

[57] ABSTRACT

Disclosed herein is a vibrator for use in a power drill having a housing and a spindle rotatably and axially movably supported by the housing. The vibrator comprises a rotary cam fitted on the spindle for rotation with the spindle, the rotary cam having a cam surface formed with at least one axially protruding ridge or serration; a clutch cam axially slidably fitted on the spindle and disposed behind the rotary cam, the clutch cam being restricted from rotating about the spindle and releasably engageable with the rotary cam, the clutch cam having a cam surface formed with at least one axially protruding ridge; and a spring adapted to urge the clutch cam toward the rotary cam so as to absorb the axial thrusting force applied to the spindle when the spindle is retracted. When the resilience of the spring overcomes the thrusting force, the rotary cam in motion is axially vibrated along with the spindle in conformity with the cam surface of the clutch cam, and on the other hand, when the thrusting force exceeds the resilience of the spring, the clutch cam is axially rearwardly moved in conformity with the cam surface of the rotary cam in motion, and then brought into collision with the rotary cam by virtue of the resilience of the spring so as to strike the rotary cam. With this construction, if excessive thrusting force is applied to the spindle when driven for rotation and vibration, it is absorbed to be changed into impacting force for effectively vibrating the spindle so as to reduce the load to the motor.

2 Claims, 6 Drawing Figures

VIBRATING MEANS IN A POWER DRILL

BACKGROUND OF THE INVENTION

1. Field of the Invention

The present invention relates to vibrating means in a power drill, and more particularly to vibrating means which allows the power drill to selectively perform single operation of rotation only and composite operation of rotation and vibration for drilling.

2. Description of the Prior Art

The prior art vibrating means for use in a power drill comprises a spindle which is driven for rotation by a motor and is axially vibrated through sliding contact between the cam surface of a rotary cam fitted on the spindle and the cam surface of a fixed cam disposed in opposed relation to the rotary cam. In this case, however, as axial thrusting force applied to the spindle increases, the contact pressure between the two cam surfaces increases unlimitedly, and as the result, damping force is applied to the rotary cam, which, in turn, will result in remarkably increased load to the motor. Thus, the degree of loss of the driving energy for the spindle becomes excessive in comparison with the power of the spindle. In case the power supply for the motor is a battery, conspicuous consumption of the battery is a grave disadvantage.

SUMMARY OF THE INVENTION

An object of the present invention is to eliminate the above disadvantage associated with the prior art by providing vibrating means for use in a power drill in which, when thrusting force greater than a predetermined limit is applied to the spindle, the thrusting force is absorbed to be changed into impacting force for vibrating the spindle, thereby reducing the load to the motor.

Another object of the present invention is to provide vibrating means in a power drill which permits ready and simple selective operation between single operation of rotation only and composite operation of rotation and vibration.

According to the present invention, there is provided vibrating means for use in a power drill having a housing and a spindle rotatably and axially movably supported by the housing. The inventive vibrating means comprises a rotary cam fitted on the spindle for rotation with the spindle, the rotary cam having a cam surface formed with at least one axially protruding ridge; a clutch cam axially slidably fitted on the spindle and disposed behind the rotary cam, the clutch cam being restricted from rotating about the spindle and releasably engageable with the rotary cam, the clutch cam having a cam surface formed with at least one axially protruding ridge; and a spring adapted to urge the clutch cam toward the rotary cam so as to absorb the axial thrusting force applied to the spindle when the spindle is retracted. When the resilience of the spring overcomes the thrusting force, the rotary cam in motion is axially vibrated along with the spindle in conformity with the cam surface of the clutch cam, and on the other hand, when the thrusting force exceeds the resilience of the spring, the clutch cam is moved axially rearwardly in conformity with the cam surface of the rotary cam in motion, and then brought into collision with the rotary cam by virtue of the resilience of the spring so as to strike the rotary cam. With this construction, if excessive thrusting force is applied to the spindle when driven for rotation and vibration, it is absorbed to be changed into impacting force for effectively vibrating the spindle so as to reduce the load to the motor.

The invention will become more fully apparent from the claims and the description as it proceeds in connection with the drawings.

DETAILED DESCRIPTION OF A PREFERRED EMBODIMENT

Figure 1:
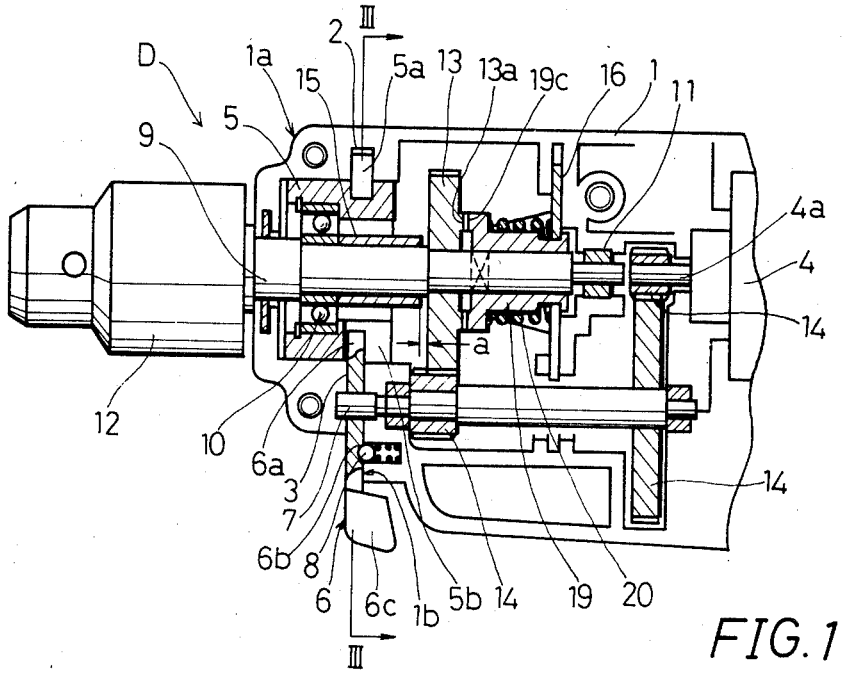
FIG. 1 is a side sectional view of the essential parts of a power drill including an embodiment of the present invention.
Figure 2:
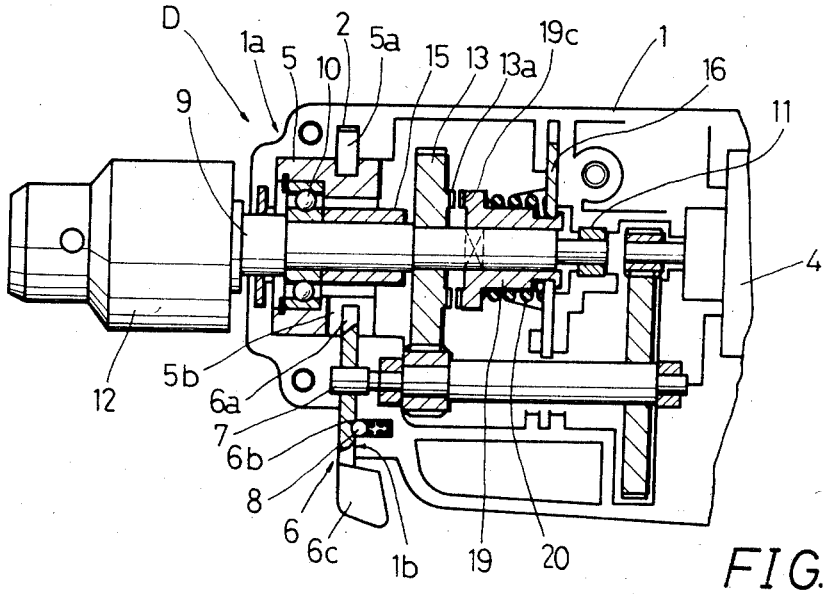
FIG. 2 is a side sectional view similar to FIG. 1 and illustrates cam being disengaged from the clutch cam.
Figure 3:
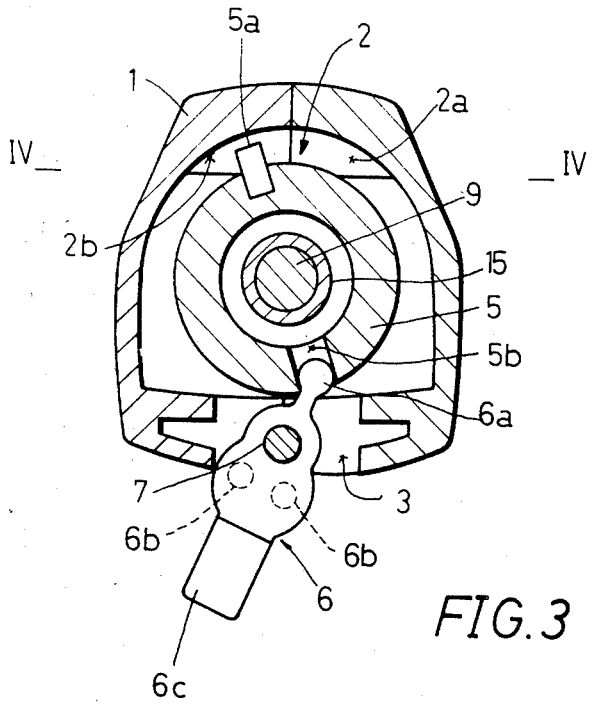
FIG. 3 is a sectional view taken along line III—III in FIG. 1.
Figure 4:
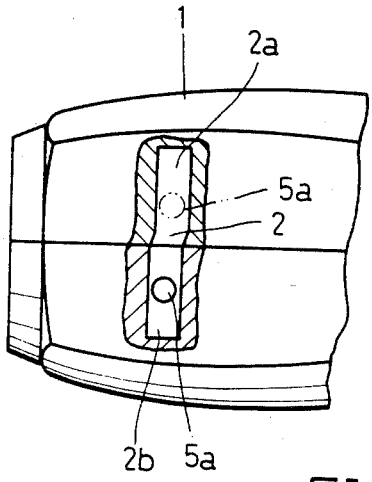
FIG. 4 is a sectional view taken along line IV—IV in FIG. 3.

Referring now to FIGS. 1 to 6 in which a preferred embodiment of the present invention is shown, a power drill D has a housing 1 which is assembled of a pair of vertically splittable halves. The housing 1 has a forward end 1*a*, and a slide groove 2 transversely provided on the upper end surface thereof near the forward end la and composed of left and right transverse grooves 2*a* and 2*b* which are offset in communication to each other (FIGS. 2 and 4). The housing 1 further has at the lower end thereof near the forward end 1*a* a through opening 3, and a motor 4 is encased within the housing 1 at the rearward end thereof.

Numeral 5 indicates a substantially hollow cylindrical selector ring slidingly rotatably received within the forward end 1*a*. The selector ring 5 has a guide pin 5*a* provided near the upper rearmost end thereof and adapted to be projected into the slide groove 2 of the housing 1, and a slot 5*b* defined at the lower rearmost surface thereof.

Numeral 6 indicates a selector lever which is transversely pivotally mounted on the lower portion near the forward end 1*a* of the housing 1 through a pin 7 so as to rotatingly slide the selector ring 5 in the longitudinal direction. The selector lever 6 has at the upper end thereof an engaging portion 6*a* extending into the through opening 3 into the housing 1 and fitted into the slot 5*b* of the selector ring 5 so as to establish connection between the selector lever 6 and the selector ring 5 (FIG. 3). The housing 1 has a spherical stopper 8 resiliently held within and out of the wall 1*b* thereof below the through opening 3. The selector lever 6 has on the back surface of the central portion thereof right and left engaging recesses 6*b* spherically concaved and adapted for receiving the stopper 8 so as to lock the selector lever 6 at the right and left pivoted positions. The selector lever 6 further has a handle 6*c* projecting downwardly from the forward end 1*a* of the housing 1. When the handle 6*c* is operated to keep the selector lever 6 at the right or left pivoted position, the selector ring 5 is slidingly rotated to be moved to the advanced or retracted position through the guide pin 5*a* which is slided within the slide groove 2 of the housing 1 (FIG. 4).

Turning to FIG. 1, numeral 9 indicates a spindle extending longitudinally through the housing 1. The spindle 9 is rotatably and axially slidably supported by the housing 1 through a front bearing 10 which is fitted in the selector ring 5 in such a way as to be axially movable along with the selector ring 5 and a rear bearing 11. When the selector ring 5 is moved to its advanced position, the spindle 9 is moved forwardly along with the selector ring 5 through the front bearing 10 and held at its advanced position against backward movement. When the selector ring 5 is moved to its retracted position, the spindle 9 is allowed to go backwardly.

Numeral 12 indicates a drill chuck fitted on the extreme end of the spindle 9.

A rotary cam 13 is a gear-like member fitted on the spindle 9 around the medial portion thereof in such a way as to be axially movable and rotatable along with the spindle 9. When rotation of the motor shaft 4*a* of the motor 4 is transmitted through gears 14, the rotary cam 13 is driven for rotation along with the spindle. The rotary cam 13 has on the rear end surface thereof a cam surface 13*a* formed with a plurality of ridges extending axially from the peripheral portion thereof. Such a peripherally serrated cam surface 13*a* is shown in FIGS. 5 and 6.

A sleeve 15 is loosely fitted on the spindle 9 between the rotary cam 13 and the front bearing 10. There is provided a clearance a between the rearmost end of the sleeve 15 and the rotary cam 13 so as to allow axial vibration of the rotary cam 13 when the spindle 9 is retracted.

Figure 5:
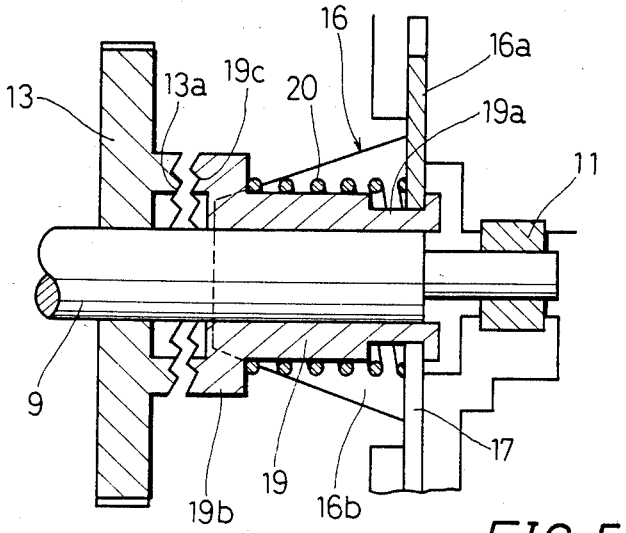
FIG. 5 is an enlarged fragmentary side sectional view of the essential parts of the present invention.
Figure 6:
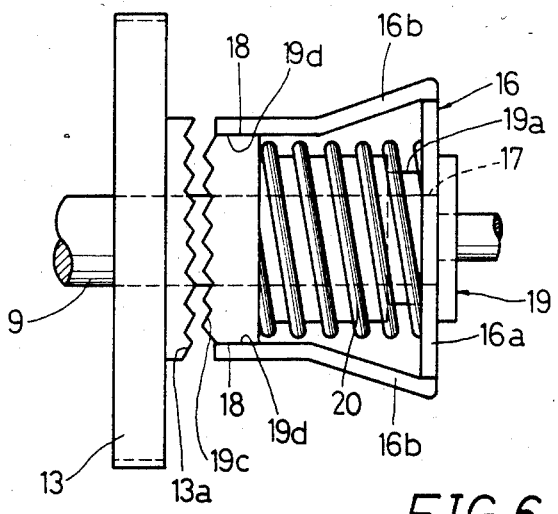
FIG. 6 is a top plan view of FIG. 5.

Referring now to FIGS. 5 and 6, numeral 16 indicates a retainer tightly carried by the housing 1 around the rear end of the spindle 9. The retainer 16 has a vertical base piece 16*a* and an inverted U-shaped engaging groove 17 defined at the lower portion of the base piece 16*a* so as to straddle the spindle 9. The retainer 16 further has a pair of right and left crooked arm pieces 16*b* extending forwardly from the medial portions of both side edges of the base piece 16*a*. The arm pieces 16*b* have on the extreme end inside surfaces thereof guide surfaces 18 formed vertically in opposing relation to each other.

Numeral 19 indicates a substantially cylindrical clutch cam loosely fitted on the spindle 9 in such a way as to be slidable in the axial direction of the spindle 9. The clutch cam 19 is disposed rearwardly of the rotary cam 13 and adapted to releasably engage the rotary cam 13. The clutch cam 19 has around the rear end portion thereof a circumferencial restriction groove 19*a* adapted to engage the engaging groove 17 of the retainer 16 in such a way as to allow longitudinal movement within a restricted range. The clutch cam 19 further has a flange portion 19*b* provided at the forward end thereof. The flange portion 19*b* has on the forward end surface thereof a cam surface 19*c* formed with a plurality of ridges extending axially from the peripheral portion thereof, which cam surface 19*c* being adapted to engage the cam surface 13*a* of the rotary cam 13 in meshing relation thereto. The flange portion 19*b* has at both sides thereof slide surfaces 19*d* which are vertically formed and held between the guide surfaces 18 of the retainer 16 to restrict rotation of and to allow longitudinal sliding movement of the clutch cam 19.

Numeral 20 indicates a spring positioned between the base piece 16*a* of the retainer 16 and the flange portion 19*b* of the clutch cam 19 and adapted to normally urge the clutch cam 19 forwardly against the rotary cam 13. When the spinde 9 is retracted, the cam surface 19*c* of the clutch cam 19 is pressed against the cam surface 13*a* of the rotary cam 13 by the spring 20. When the resilience of the spring 20 applied to the clutch cam 19 overcomes the axial thrusting force applied to the spindle 9 when it is retracted, or in other words, the thrusting force causes no compression deformity of the spring 20, the rotating rotary cam 13 is axially vibrated in conformity with the serrated cam surface 19*c* of the clutch cam 19. On the contrary, when the thrusting force exceeds the resilience of the spring 20, or the thrusting force causes compression deformity of the spring 20, the clutch cam 19 is axially retracted in conformity with the serrated cam surface 13*a* of the rotary cam 13 and then advanced from its retracted position by virture of the resilience of the spring 20 until it comes into collision with the rotary cam 13. Thus, the rotary cam 13 is repeatedly struck to be vibrated along with the spindle 9.

When the spindle 9 is held at its advanced position, the rotary cam 13 is disengaged from the clutch cam 19 so that only the rotating operation is transmitted to the spindle 9 (FIG. 2).

Now, the operation of the means thus constructed is as follows. Generally, when work surface is being drilled, the selector lever 6 is pivotally operated to move the selector ring 5 to its retracted position. Then, when the spindle 9 is rotated and a drill bit or other tool (not shown) attached to the drill chuck 12 is pressed against the work surface, the spindle 9 is moved backwardly and the rotary cam 13 is brought into meshing contact with the clutch cam 19, to thereby establish pressing contact between the two cam surfaces 13*a* and 19*c* (FIG. 1).

When the resilience of the spring 20 overcomes the thusting force applied to the spindle 9 by the work, the spindle 9 is vibrated through the rotary cam 13 which is, in turn, vibrated in conformity with the cam surface 19*c* of the clutch cam 19. Now, the spindle 9 performs the combined operation of rotation and vibration to drill the work surface.

On the other hand, when the thrusting force applied to the spindle 9 exceeds the resilience of the spring 20, the rotary cam 13 is struck due to reaction of the clutch cam 19 which is moved backwardly in conformity with the cam surface 13*a* of the rotary cam 13. Thus, the spindle 9 can be vibrated. At this time, the thrusting force applied to the spindle 9 is absorbed by the spring 20, and furthermore, the thrusting force is effectively used to be changed into impacting force for vibrating the spindle 9.

Thus, even when excessive thrusting force is applied to the spindle during drilling, backward movement of the clutch 19 and its reaction ensures positive vibration of the spindle 9, and thereby energy loss for driving the spindle 9 will be decreased to reduce the load to the motor 4.

While the invention has been described with reference to a preferred embodiment thereof, it is to be understood that modifications or variations may be easily made without departing from the scope of the present invention which is defined by the appended claims.

What is claimed is:

1. Vibrating means for use in a power drill comprising: a housing; a spindle rotatable and axially movable within and supported by said housing; a selector ring at least partially rotatable and axially movable within said housing and operatively connected to said spindle for controlling the axial movement thereof; a rotary cam fixed on said spindle and having a serrated clutch surface formed on the rearward end thereof; a clutch cam axially slidable between an advanced position in engagement with said rotary cam and a retracted position disengaged from said rotary cam, said clutch cam being loosely fitted on but restricted from rotation about said spindle and having a serrated clutch surface formed on the forward end thereof in confronting relation to said serrated surface of said rotary cam and adapted for frictional engagement therewith; a retainer secured to said housing and having means thereon engageable with said clutch cam to hold said clutch cam from rotation but to permit limited axial slidable movement thereof; and a spring positioned between said clutch cam and said retainer to resiliently hold said clutch cam in its advanced position against any thrusting force being applied thereto so that as said rotary cam is rotated by said spindle, said rotary cam is vibrated with said spindle due to the relative sliding engagement between the respective serrated clutch surfaces of said rotary cam and said clutch cam, whereby when a thrusting force of up to a predetermined threshold magnitude is applied to said spindle such as to rearwardly move said clutch cam, said spring urges said clutch cam toward said rotary cam so as to absorb the thrusting force; and whereby when a thrusting force in excess of said predetermined threshold magnitude is applied to said spindle to rearwardly move said clutch cam which latter force exceeds the resilience and the biasing action of said spring through the rotatipnal movement of said rotary cam, said clutch cam is rebounded to advance from its retracted position by reason of the repulsion of said spring contracted to absorb the excessive force, thereby striking said rotary cam, and said rotary cam is vibrated along with said spindle by reason of the repeated striking actions of said clutch cam during rotational movement of said rotary cam thereby converting the torque of said rotary cam into impacting force to be applied to said rotary cam.

2. The vibrating means as defined in claim 1 wherein said rotary cam is a gear-like member suitable for transmission of rotation thereto.

* * * * *